US007213409B1

(12) United States Patent
Nuckols

(10) Patent No.: US 7,213,409 B1
(45) Date of Patent: May 8, 2007

(54) RECONFIGURABLE HYDROGEN TRANSFER HEATING/COOLING SYSTEM

(75) Inventor: Marshall L. Nuckols, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 183 days.

(21) Appl. No.: 11/183,309

(22) Filed: Jul. 14, 2005

(51) Int. Cl.
*F25D 17/04* (2006.01)

(52) U.S. Cl. ..... 62/408

(58) Field of Classification Search ..... 62/4, 62/48.1, 48.3, 408, 477, 119; 165/104.12, 165/179; 96/126
See application file for complete search history.

(56) References Cited

U.S. PATENT DOCUMENTS

| | | | | | |
|---|---|---|---|---|---|
| 4,165,569 | A | | 8/1979 | Mackay | |
| 4,178,987 | A | * | 12/1979 | Bowman et al. | 165/104.12 |
| 4,185,979 | A | | 1/1980 | Woolley | |
| 4,200,144 | A | | 4/1980 | Sirovich | |
| 4,393,924 | A | * | 7/1983 | Asami et al. | 165/104.12 |
| 4,422,500 | A | * | 12/1983 | Nishizaki et al. | 165/104.12 |
| 4,457,136 | A | * | 7/1984 | Nishizaki et al. | 62/46.2 |
| 4,489,564 | A | * | 12/1984 | Hausler et al. | 62/46.2 |
| 4,548,044 | A | * | 10/1985 | Sakai et al. | 62/46.2 |
| 4,566,281 | A | * | 1/1986 | Sandrock et al. | 62/46.3 |
| 4,716,736 | A | * | 1/1988 | Schwarz | 62/46.2 |
| 4,819,717 | A | * | 4/1989 | Ishikawa et al. | 165/104.12 |
| 4,928,496 | A | * | 5/1990 | Wallace et al. | 62/46.2 |
| 5,042,259 | A | | 8/1991 | Jones | |
| 5,351,493 | A | * | 10/1994 | Hiro et al. | 62/46.2 |
| 6,000,463 | A | | 12/1999 | Astakhov | |
| 6,616,738 | B2 | * | 9/2003 | Iwamoto et al. | 96/146 |
| 2005/0253019 | A1 | * | 11/2005 | Hoehne et al. | 244/129.1 |

FOREIGN PATENT DOCUMENTS

EP 0061191 A * 9/1982

* cited by examiner

*Primary Examiner*—Mohammad M. Ali
(74) *Attorney, Agent, or Firm*—James T. Shepherd

(57) ABSTRACT

A reconfigurable system is provided for effecting temperature changes. A first thermally-conductive container stores a metal hydride while a second thermally-conductive container stores a metal alloy that is capable of absorbing hydrogen atoms at a pressure that is less than the storage pressure of the metal hydride. A valved conduit links the metal hydride and the metal alloy. A thermal insulator is disposed about one of the containers depending on whether the system is to be used for cooling or heating. A circulating fluid is placed in thermal communication with the insulated container and with an environment requiring temperature changes. When the conduit's valve is opened, hydrogen atoms desorbed from the metal hydride are transported through the conduit and are absorbed by the metal alloy. Desorption of the hydrogen generates a cooling effect while absorption of the hydrogen generates heat.

21 Claims, 1 Drawing Sheet

RECONFIGURABLE HYDROGEN TRANSFER HEATING/COOLING SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to heating and cooling systems based on hydrogen transfer, and more particularly to a hydrogen transfer based system that can be configured to heat or cool small human-occupied environments.

BACKGROUND OF THE INVENTION

Small human-occupied, man-made environments that are used or immersed in harsh ambient environments may require heating or cooling in order to provide safe and comfortable temperature conditions for their human occupant(s). For example, garments worn by divers, firefighters, chemical "hazmat" workers, etc., frequently must be heated or cooled depending on ambient environmental conditions. In addition, small chambers such as dive chambers or hyperbaric chambers must also be heated or cooled. In each of these cases, constraints on size, weight, power availability and/or power consumption limit the types of heating or cooling systems that can be used. Furthermore, since some applications of these human-occupied environments may require heating while other applications may require cooling, it is advantageous to have a single system that is capable of being configured for heating or cooling as dictated by the particular application conditions.

SUMMARY OF THE INVENTION

Accordingly, it is an object of the present invention to provide a system for effecting temperature changes.

Another object of the present invention is to provide a system that can be configured to heat or cool small human-occupied environments.

Still another object of the present invention is to provide a system that can be configured for heating or cooling without the need for a power supply during the operation thereof.

Other objects and advantages of the present invention will become more obvious hereinafter in the specification and drawings.

In accordance with the present invention, a system is provided for effecting temperature changes in an environment. A first thermally-conductive container stores a metal hydride at ambient temperature and a storage pressure that is greater than ambient pressure. A second thermally-conductive container stores a metal alloy at ambient temperature and ambient pressure. The metal alloy is one that is capable of absorbing hydrogen atoms at a pressure that is less than the storage pressure of the metal hydride. A conduit, coupled between the first and second thermally-conductive containers, is in communication at a first end thereof with the metal hydride and in communication at a second end thereof with the metal alloy. A valve is disposed in the conduit for controlling communication between the first end second end thereof. A thermal insulator is disposed about one of the first and second thermally-conductive containers depending on whether the system is to be used for cooling or heating. A circulating fluid is (i) placed in thermal communication with the one of the first and second thermally-conductive containers that is insulated by the thermal insulator, and (ii) adapted to be in thermal communication with an environment requiring temperature changes. As a result of this system structure, when the valve is opened, hydrogen atoms desorbed from the metal hydride are transported through the conduit and are absorbed by the metal alloy. Desorption of the hydrogen generates a cooling effect while absorption of the hydrogen generates heat.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
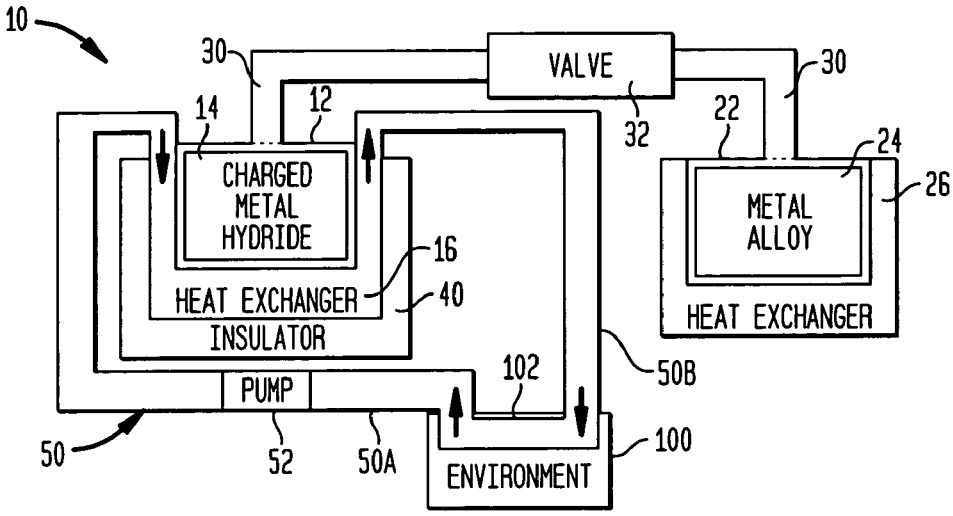
FIG. 1 is a schematic view of a reconfigurable hydrogen-transfer heating/cooling system configured for cooling in accordance with the present invention.

Referring now to the drawings, simultaneous reference will be made to FIGS. 1 and 2 where a reconfigurable system for effecting temperature changes in a small human-occupied, man-made environment 100 is illustrated generally by reference numeral 10. In FIG. 1, system 10 is configured for cooling environment 100 while, in FIG. 2, system 10 is configured for heating environment 100. By way of non-limiting examples, environment 100 can be a garment such as that worn by a diver, firefighter, chemical or biological "hazmat" worker, military personnel, etc. Environment 100 could also be a small chamber used to temporarily house humans as is the case with dive chambers, submarine rescue chambers, hyperbaric chambers, etc.

Whether used for heating or cooling, system 10 generally includes the following:

a thermally-conductive container 12 for storing a charged metal hydride 14 therein;

a heat exchanger 16 thermally coupled to container 12;

a thermally-conductive container 22 for storing a metal alloy 24 therein, a heat exchanger 26 thermally coupled to container 22;

a conduit 30 that is open on either end thereof with one open end exposed to metal hydride 14 and the other open end exposed to metal alloy 24;

a user-controllable valve 32 disposed in conduit 32 with valve 32 being closed until system 10 is to be used for heating or cooling;

a thermal insulator 40 disposed about one of (i) container 12/heat exchanger 16 when system 10 is used for cooling, or (ii) container 22/heat exchanger 26 when system 10 is used for heating; and a fluid circulation system 50 coupled to one of (i) heat exchanger 16 when system 10 is used for cooling, or (ii) heat exchanger 26 when system 10 is used for heating.

Regardless of whether system 10 is used for heating or cooling, charged metal hydride 14 is any metal hydride that stores hydrogen atoms therein at an ambient temperature and a storage pressure that is greater than ambient pressure. Accordingly, container 12 is a housing or canister capable of retaining the storage pressure. Such metal hydrides as well as methods of charging or saturating same with hydrogen are well known in the art. Metal alloy 24 is any metal alloy that is capable of absorbing hydrogen atoms at ambient temperature and a pressure that is less than the pressure at which metal hydride 14 is stored. The lower the hydrogen absorbing pressure of metal alloy 24, the greater the heating or cooling differential produced during operation of system 10.

Figure 3:
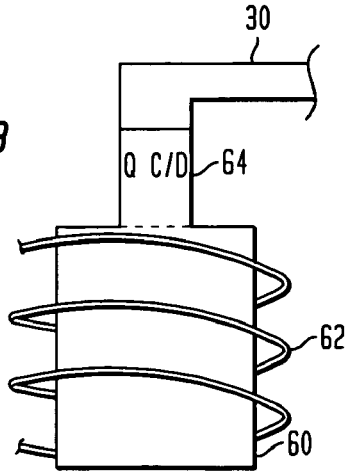
FIG. 3 is an isolated view of a metal hydride or metal alloy canister with a fluid-carrying heat transfer coil wrapped thereabout in accordance with an embodiment of the present invention.

Container 12/heat exchanger 16 and container 22/heat exchanger 26 can be realized in a variety of ways without departing from the scope of the present invention. For example, as illustrated in FIG. 3, each container/heat exchanger combination could be realized by a thermally-conductive container 60 having a thermally-conductive conduit 62 coiled about and in thermal communication with container 60. Container 60 and conduit 62 can be individual elements or integrated into a single element. To facilitate the quick installation and removal of container 60 from the system of the present invention, a quick connect/disconnect ("Q C/D") coupling 64 can be used to couple container 60 to conduit 30.

In general, fluid circulation system 50 can be any fluid-carrying system of pipes, ducts, or other conduits used to transport a fluid medium (e.g., a liquid such as water, a gas such as air, etc.) therein between environment 100 and heat exchanger 16 (in the case of a cooling operation) or heat exchanger 26 (in the case of a heating operation). More specifically, fluid circulation system 50 has (i) a conduit 50A leading from environment 100 to one of heat exchanger 16 or 26, and (ii) a conduit 50B leading from one of heat exchanger 16 or 26 to environment 100. A pump 52 can be included along one (or both) of conduits 50A and 50B to facilitate circulation of the fluid medium therein. Coupling/uncoupling of conduits 50A/SOB can be accomplished in any of a variety of ways well known in the art. Typically, some form of quick connect/disconnect would be used to simplify reconfiguration of system 10.

In most instances, environment 100 will include its own internal pipes, ducts, or other conduits 102 that facilitate the movement of the fluid medium (passed through circulation system 50) therethrough. For example, if environment 100 is a garment, conduit 102 represents a fluid circulation tube integrated into the garment. If environment 100 is a small chamber, conduit 102 could be ductwork for transporting a gaseous fluid medium (e.g., air) therethrough. If the fluid medium is air, conduit 102 could be vented into environment 100 to allow some of the heated or cooled air to be admitted into environment 100.

In terms of a cooling operation, system 10 in FIG. 1 begins to function when valve 32 is opened. The higher pressure in container 12 immediately drops due to the lower pressure in container 22 thereby allowing hydrogen atoms stored in metal hydride 14 to be released or desorbed. The hydrogen release is an endothermic reaction that causes a temperature drop in metal hydride 14. This temperature drop is transferred (via heat exchanger 16) to the fluid medium circulating through circulating system 50. At the same time, metal alloy 24 absorbs the hydrogen desorbed from metal hydride 14. Such hydrogen absorption is an exothermic reaction that produces heat which, in turn, is transferred to heat exchanger 26. The heat in heat exchanger 26 could be used for some purpose or could be "dumped". For example, if environment 100 is a garment, it may be advantageous to place heat exchanger 26 in thermal communication with the ambient environment in order to dissipate the heat therein.

Figure 2:
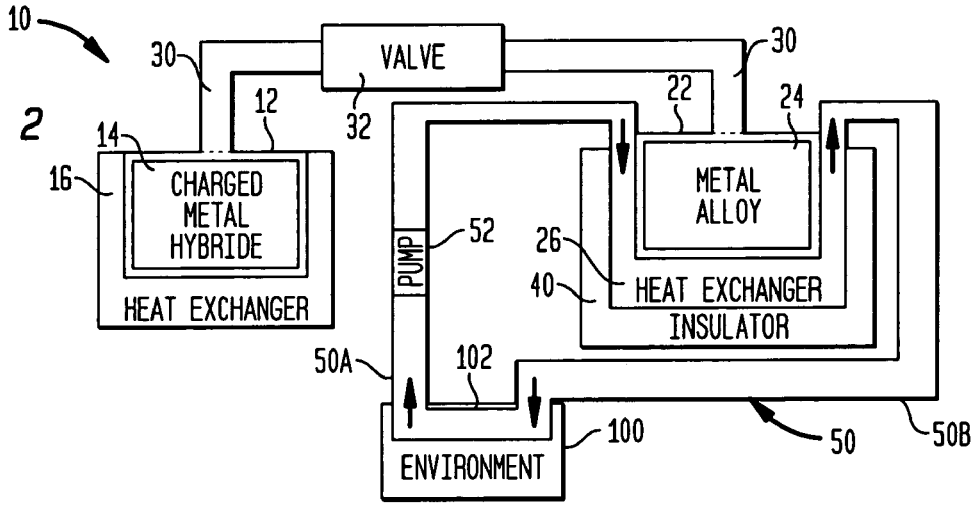
FIG. 2 is a schematic view of the reconfigurable hydrogen-transfer heating/cooling system configured for heating in accordance with the present invention.

In terms of a heating operation, system 10 in FIG. 2 similarly begins to function when valve 32 is opened. Just as in the cooling operation, the higher pressure in container 12 immediately drops thereby allowing hydrogen atoms stored in metal hydride 14 to be released or desorbed. The hydrogen release is an endothermic reaction that causes a temperature drop in metal hydride 14. This temperature drop is transferred to heat exchanger 16 while the corresponding temperature increase in metal alloy 24 (due to the absorption of the hydrogen desorbed from metal hydride 14) is transferred to the fluid medium circulating through circulating system 50 (via heat exchanger 26). Similar to the cooling operation, if environment 100 is a garment, it may be advantageous to place heat exchanger 16 in thermal communication with the ambient environment.

The advantages of the present invention are numerous. The system can be readily configured for heating or cooling.

No power supply is required to initiate or maintain the heating or cooling operation. The system can be readily "re-charged" simply by installing new canisters of a pre-charged metal hydride and a metal alloy that can absorb hydrogen at a pressure that is lower than the hydrogen storage pressure of the metal hydride. The amount of heating or cooling can be increased by using a metal alloy having a lower hydrogen absorption pressure.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A system for effecting temperature changes in an environment, comprising:

a first container for storing a metal hydride therein at ambient temperature and a storage pressure that is greater than ambient pressure;

a first heat exchanger in thermal communication with said first container;

a second container for storing a metal alloy therein at ambient temperature and ambient pressure, said metal alloy being capable of absorbing hydrogen atoms at a pressure that is less than said storage pressure;

a second heat exchanger in thermal communication with said second container;

a conduit coupled between said first container and said second container, said conduit in communication at a first end thereof with said metal hydride and in communication at a second end thereof with said metal alloy;

a valve disposed in said conduit for controlling communication between said first end and said second end thereof;

a thermal insulator disposed about one of said first heat exchanger and said second heat exchanger; and means for placing a circulating fluid in thermal communication with said one of said first heat exchanger and said second heat exchanger, said means for placing adapted to be in thermal communication with an environment requiring temperature changes wherein, when said valve is opened, hydrogen atoms desorbed from said metal hydride are transported through said conduit and absorbed by said metal alloy.

2. A system as in claim 1 further comprising:

a first quick connect coupling for coupling said first container to said first end of said conduit; and a second quick connect coupling for coupling said second container to said second end of said conduit.

3. A system as in claim 1 wherein said first heat exchanger comprises a coiled conduit about said first container.

4. A system as in claim 1 wherein said second heat exchanger comprises a coiled conduit about said second container.

5. A system as in claim 1 wherein the environment is a garment having fluid-carrying tubes integrated therein, and wherein said means for placing comprises:

fluid transportation means coupled to the fluid-carrying tubes for carrying said circulating fluid between (i) said one of said first heat exchanger and said second heat exchanger, and (ii) the fluid-carrying tubes; and a pump coupled to said fluid transportation means for pumping said circulating fluid therethrough.

6. A system as in claim 1 wherein the environment is a closed chamber, and wherein said means for placing comprises:

fluid transportation means passing through a portion of the closed chamber for carrying said circulating fluid to and from said one of said first heat exchanger and said second heat exchanger; and a pump coupled to said fluid transportation means for pumping said circulating fluid therethrough.

7. A system as in claim 6 wherein the circulating fluid is air, said system further comprising a vent disposed in said fluid transportation means within the chamber for venting at least a portion of said circulating fluid into the chamber.

8. A system for effecting temperature changes in a man-made environment, comprising:

a first thermally-conductive containment means for storing a metal hydride therein at ambient temperature and a storage pressure that is greater than ambient pressure;

a second thermally-conductive containment means for storing a metal alloy therein at ambient temperature and ambient pressure, said metal alloy being capable of absorbing hydrogen atoms at a pressure that is less than said storage pressure;

a conduit coupled between said first and second thermally-conductive containment means, said conduit in communication at a first end thereof with said metal hydride and in communication at a second end thereof with said metal alloy;

a valve disposed in said conduit for controlling communication between said first end and said second end thereof;

a thermal insulator disposed about one of said first and second thermally-conductive containment means; and means for placing a circulating fluid in thermal communication with said one of said first and second thermally-conductive containment means, said means for placing adapted to be in thermal communication with a man-made environment requiring temperature changes wherein, when said valve is opened, hydrogen atoms desorbed from said metal hydride are transported through said conduit and are absorbed by said metal alloy.

9. A system as in claim 8 further comprising:

a first quick connect coupling for coupling said first thermally-conductive containment means to said first end of said conduit; and a second quick connect coupling for coupling said second thermally-conductive containment means to said second end of said conduit.

10. A system as in claim 8 wherein the environment is a garment having fluid-carrying tubes integrated therein, and wherein said means for placing comprises:

fluid transportation means coupled to the fluid-carrying tubes for carrying said circulating fluid between (i) said one of said first and second thermally-conductive containment means, and (ii) the fluid-carrying tubes; and a pump coupled to said fluid transportation means for pumping said circulating fluid therethrough.

11. A system as in claim 8 wherein:

the environment is a closed chamber;

said means for placing comprises fluid transportation means passing through a portion of the closed chamber for carrying said circulating fluid to and from said one of said first and second thermally-conductive containment means, and a pump coupled to said fluid transportation means for pumping said circulating fluid therethrough;

said circulating fluid is air; and said system further comprises a vent disposed in said fluid transportation means within the chamber for venting at least a portion of said circulating fluid into the chamber.

12. A system as in claim 8, wherein:

said man-made environment is surrounded by an ambient environment; and the one of said first and second thermally-conductive containment means not having a thermal insulator disposed about it is in thermal communication with said ambient environment.

13. A system as in claim 12 further comprising:

a first quick connect coupling for coupling said first thermally-conductive containment means to said first end of said conduit; and a second quick connect coupling for coupling said second thermally-conductive containment means to said second end of said conduit.

14. A system as in claim 12 wherein the man-made environment is a garment having fluid-carrying tubes integrated therein, and wherein said means for placing comprises:

fluid transportation means coupled to the fluid-carrying tubes for carrying said circulating fluid between (i) said one of said first and second thermally-conductive containment means, and (ii) the fluid-carrying tubes; and a pump coupled to said fluid transportation means for pumping said circulating fluid therethrough.

15. A system as in claim 12 wherein:

said circulating fluid is air;

said man-made environment is a closed chamber;

said means for placing comprises fluid transportation means passing through a portion of the closed chamber for carrying said circulating fluid to and from said one of said first and second thermally-conductive containment means, and a pump coupled to said fluid transportation means for pumping said circulating fluid therethrough; and said system further comprises a vent disposed in said fluid transportation means within said chamber for venting at least a portion of said circulating fluid into said chamber.

16. A system for cooling a man-made environment that is surrounded by an ambient environment, comprising:

a first thermally-conductive container storing a metal hydride therein at ambient temperature and at a storage pressure that is greater than ambient pressure;

a second thermally-conductive container in thermal communication with the ambient environment and storing a metal alloy therein at ambient temperature and ambient pressure, said metal alloy being capable of absorbing hydrogen atoms at a pressure that is less than said storage pressure;

a first conduit coupled between said first and second containers, said conduit in communication at a first end thereof with said metal hydride and in communication at a second end thereof with said metal alloy;

a valve disposed in said conduit for controlling communication between said first end and said second end thereof wherein, when said valve is opened, hydrogen atoms are desorbed from said metal hydride, causing an endothermic reaction to reduce the temperature of said metal hydride, and said hydrogen atoms are transported through said first conduit and are absorbed by said metal alloy, causing an exothermic reaction to increase the temperature of said metal alloy;

a heat exchanger in thermal communication with said first container;

a thermal insulator disposed about said first container and said heat exchanger;

a second conduit in thermal communication with said heat exchanger and with the man-made environment needing cooling, said second conduit configured to provide a continuous path for a fluid to circulate between said heat exchanger and the man-made environment; and a pump coupled to said second conduit and configured to cause said fluid to flow through said second conduit.

17. A system as in claim 16 wherein the man-made environment is a garment having fluid-carrying tubes integrated therein, and wherein said fluid-carrying tubes are in communication with said second conduit to allow said fluid to flow through said fluid-carrying tubes.

18. A system as in claim 16 wherein:

the man-made environment is a closed chamber;

said fluid is air; and said system further comprises a vent disposed in said second conduit and said closed chamber, said vent configured to vent at least a portion of said circulating fluid into said closed chamber.

19. A system for heating a man-made environment that is surrounded by an ambient environment, comprising:

a first thermally-conductive container storing a metal alloy therein at ambient temperature and ambient pressure, said metal alloy being capable of absorbing hydrogen atoms at a pressure that is less than said storage pressure;

a second thermally-conductive container in thermal communication with the ambient environment and storing a metal hydride therein at ambient temperature and at a storage pressure that is greater than ambient pressure;

a first conduit coupled between said first and second containers, said conduit in communication at a first end thereof with said metal hydride and in communication at a second end thereof with said metal alloy;

a valve disposed in said conduit for controlling communication between said first end and said second end thereof wherein, when said valve is opened, hydrogen atoms are desorbed from said metal hydride, causing an endothermic reaction to reduce the temperature of said metal hydride, and said hydrogen atoms are transported through said first conduit and are absorbed by said metal alloy, causing an exothermic reaction to increase the temperature of said metal alloy;

a heat exchanger in thermal communication with said first container;

a thermal insulator disposed about said first container and said heat exchanger;

a second conduit in thermal communication with said heat exchanger and with the man-made environment needing heating, said second conduit configured to provide a continuous path for a fluid to circulate between said heat exchanger and the man-made environment; and a pump coupled to said second conduit and configured to cause said fluid to flow through said second conduit.

20. A system as in claim 19 wherein the man-made environment is a garment having fluid-carrying tubes integrated therein, and wherein said fluid-carrying tubes are in communication with said second conduit to allow said fluid to flow through said fluid-carrying tubes.

21. A system as in claim 19 wherein:

the man-made environment is a closed chamber;

said fluid is air; and said system further comprises a vent disposed in said second conduit and said closed chamber, said vent configured to vent at least a portion of said circulating fluid into said closed chamber.

* * * * *